US005702235A

United States Patent [19]

Hirota et al.

[11] Patent Number: 5,702,235

[45] Date of Patent: Dec. 30, 1997

[54] CAPACITY CONTROL DEVICE FOR VALIABLE-CAPACITY COMPRESSOR

[75] Inventors: Hisatoshi Hirota; Naoyuki Ito, both of Tokyo, Japan

[73] Assignee: TGK Company, Ltd., Tokyo, Japan

[21] Appl. No.: 629,606

[22] Filed: Apr. 9, 1996

[30] Foreign Application Priority Data

Oct. 31, 1995 [JP] Japan ..... 7-283140
Mar. 7, 1996 [EP] European Pat. Off. ..... 96103572

[51] Int. Cl.[6] ..... F04B 1/26

[52] U.S. Cl. ..... 417/222.2; 417/270; 91/505

[58] Field of Search ..... 417/222.2, 270; 91/504, 505

[56] References Cited

U.S. PATENT DOCUMENTS 4,747,754 5/1988 Fujii et al. ..... 417/270
5,000,666 3/1991 Esaki ..... 417/222.2
5,486,098 1/1996 Kimura et al. ..... 417/222.2

*Primary Examiner*—Charles G. Freay
*Attorney, Agent, or Firm*—Nilles & Nilles, S.C.

[57] ABSTRACT

A capacity control device for variable-capacity compressors with a high-pressure valve portion 36 for opening or closing the communication between the discharge chamber 21 and the crank case 12; a low-pressure valve portion 41 for opening or closing the communication between the suction chamber 20 and the crank case 12; a valve open-close member 35 for opening or closing so as to reverse the open-close relationship between the high-pressure valve portion 36 and the low-pressure valve portion 41 by advancing or retreating; a pressurising chamber 53 for applying pressure to the valve open-close member 35 in a direction that opens the high-pressure valve portion 36 by a wider effective pressure-receiving area than that of the high-pressure valve portion 36. The device is driven with only small actuation forces by an electromagnetic solenoid 50 to open or close a communicating path between the discharge chamber 21 and the pressurising chamber 53 (FIG. 1).

15 Claims, 6 Drawing Sheets

12(Pc)
10
14
17
15
21(Pd)
20(Ps)
38
42
43
36
54
37
47
48
49
35
41
44
53
50
50a
50b 32
35
47
44
49
42
48
43

47
48
54
38
35
49
42
53
43

CAPACITY CONTROL DEVICE FOR VALIABLE-CAPACITY COMPRESSOR

BACKGROUND OF THE INVENTION

1. Field of the Invention

The present invention relates to a capacity control device for a variable-capacity compressor used to compress a refrigerant in a refrigerating plant for an automotive air conditioning equipment.

2. Discussion of the Related Art

A prior-art compressor for use with a refrigerating plant of an automotive air conditioning equipment is driven by the engine of the automobile. The rotational speed of the compressor cannot be controlled individually because the compressor is directly coupled to the engine through a belt. In order to obtain a proper cooling capacity without being restricted by the engine speed, a variable-capacity compressor capable of changing the refrigerant capacity discharge amount is used. Such compressors are adapted to provide high specific capacity with low speed and low specific capacity with high speed. In such a variable capacity compressor, a rocking plate, the inclination angle of which is variable, is generally driven by rotational motion of a rotating shaft for rocking motion in an airtight crank case. A piston, which reciprocates by the rocking motion of the rocking member, sucks refrigerant from a suction chamber into a cylinder for compression and discharges it into a discharge chamber. A difference between the pressure in the crank case and the pressure in the suction chamber changes the inclination angle of the rocking member to hereby change the discharge amount of refrigerant. In order to change the inclination angle of the rocking plate when needed, a capacity control device is provided. The high-pressure valve portion of the device serves for opening or closing the communication between the discharge chamber and the crank case. The low-pressure valve portion serves for opening or closing the communication between the suction chamber and the crank case. Both valve portions conventionally are opened or closed by an electromagnetic solenoid reversing the open/close relationship between both valves upon actuation. Since it is apprehended that the pressure in the discharge chamber into which the compressed refrigerant is discharged may be at as high a pressure as, for example, about 30 Bar, it is necessary to have appropriately strong current to flow through the electromagnetic coil of the driving electromagnetic solenoid to open the high-pressure valve portion in communication with the discharge chamber against this high pressure. The flow of large currents causes the electromagnetic coil to generate considerable heat. This may cause a defect such as refrigerant leakage when, for example, a sealing O-ring is deteriorated by the heat.

OBJECTS AND SUMMARY OF THE INVENTION

It is an object of the present invention to provide a capacity control device for a variable-capacity compressor, the device being capable of opening or closing the valve of the high-pressure valve portion with a small force, and requiring only a small current for the electromagnetic solenoid driving the valve.

In order to achieve the above-described object, a capacity control device is provided having a high-pressure valve portion, a low-pressure valve portion, a valve operating member, a pressurizing chamber, and a pilot valve portion. The high-pressure valve portion is selectively actuatable to open or close a fluid communication path between the discharge chamber and the crank case of the variable-capacity compressor. The low-pressure valve portion is selectively actuatable to open or close a fluid communication path between the suction chamber and the crank case. The valve operating member actuates the high-pressure valve portion and low-pressure valve portion and is movable between 1) a first position in which the valve operating member causes the high-pressure valve portion to assume an open position and the low-pressure valve portion to assume a closed position and 2) a second position in which the valve operating member causes the high-pressure valve portion to assume a closed position and the low-pressure valve portion to assume an open position. The pressurizing chamber is in fluid communication with the valve operating member such that fluid pressure in the pressurizing chamber tends to drive the valve operating member towards the first position. The pressurizing chamber has an effective pressure receiving area that is larger than the effective pressure receiving area of the high-pressure valve portion. The pilot valve portion is selectively actuatable to open or close a fluid communication path between the discharge chamber and the pressurizing chamber. The pilot valve portion has an effective pressure receiving area that is smaller than the effective pressure receiving area of the high-pressure valve portion. An electromagnetic solenoid actuates the pilot valve portion.

In the capacity control device for a compressor having a rocking member provided as to vary its inclination angle with respect to a rotating shaft in an airtight crank case, said rocking member being driven by rotational motion of the rotating shaft for rocking motion, and a piston connected to the rocking member, for discharging a refrigerant into a discharge chamber after sucking the refrigerant from a suction chamber into a cylinder for compression by reciprocating, said device serving for controlling the capacity of the variable-capacity compressor in which the inclination angle of the rocking member is changed by means of the difference between a pressure in the crank case and a pressure in the suction chamber to thereby change the discharge amount of the refrigerant, the following structural features are provided:

A high-pressure valve portion for opening or closing the communication between the discharge chamber and the crank case; a low-pressure valve portion for opening or closing the communication between the suction chamber and the crank case;

a valve opening/closing member for opening or closing so as to reverse the open-close relationship between the high-pressure valve portion and the low-pressure valve portion by advancing or reacting;

a pressurising chamber for applying pressure to the valve opening/closing member in a direction that opens the high pressure valve portion by means of a bigger effective pressure-receiving area than the pressure receiving area of the high-pressure valve portion; and a pilot valve portion having a smaller effective pressure-receiving area than the high-pressure valve portion, for being driven by an electromagnetic solenoid to open or close the communicating path between the discharge chamber and the pressurising chamber.

The pressure controlled by the pilot valve portion is used to actuate the operating member in the opening sense of the high pressure valve portion and with relatively high force. High pressure acting on the high pressure valve portion in the closing direction needs said relatively high force at the operating member to overcome the closing force. This high force is generated without direct assistance by the solenoid, but instead by a servo-effect of the pressure acting in the opening direction on the operating member. The pilot valve portion with its small effective pressure receiving area, on which the high pressure is also acting in closing direction, thus needs a weak opening force only. This opening force can easily be generated by the solenoid and with relatively low exciting current and consequently weak heat generation in the coil of the solenoid. Furthermore, the relatively low opening force of the pilot valve portion and a moderate control flow rate through the pilot valve position lead to a precise control of the servo-effect, and consequently of the reciprocating operation of the high pressure valve portion and low pressure valve portion and finally of the variation of the compressor capacity. It is possible to use a compact, lightweight and inexpensive solenoid, because the solenoid is assisted by the servo-effect which uses the inherent pressure capacity of the high pressure refrigerant in the system.

BRIEF DESCRIPTION OF THE DRAWINGS

The invention will be described with reference to the drawings. In the drawings are.

DESCRIPTION OF THE PREFERRED EMBODIMENTS

Figure 1:
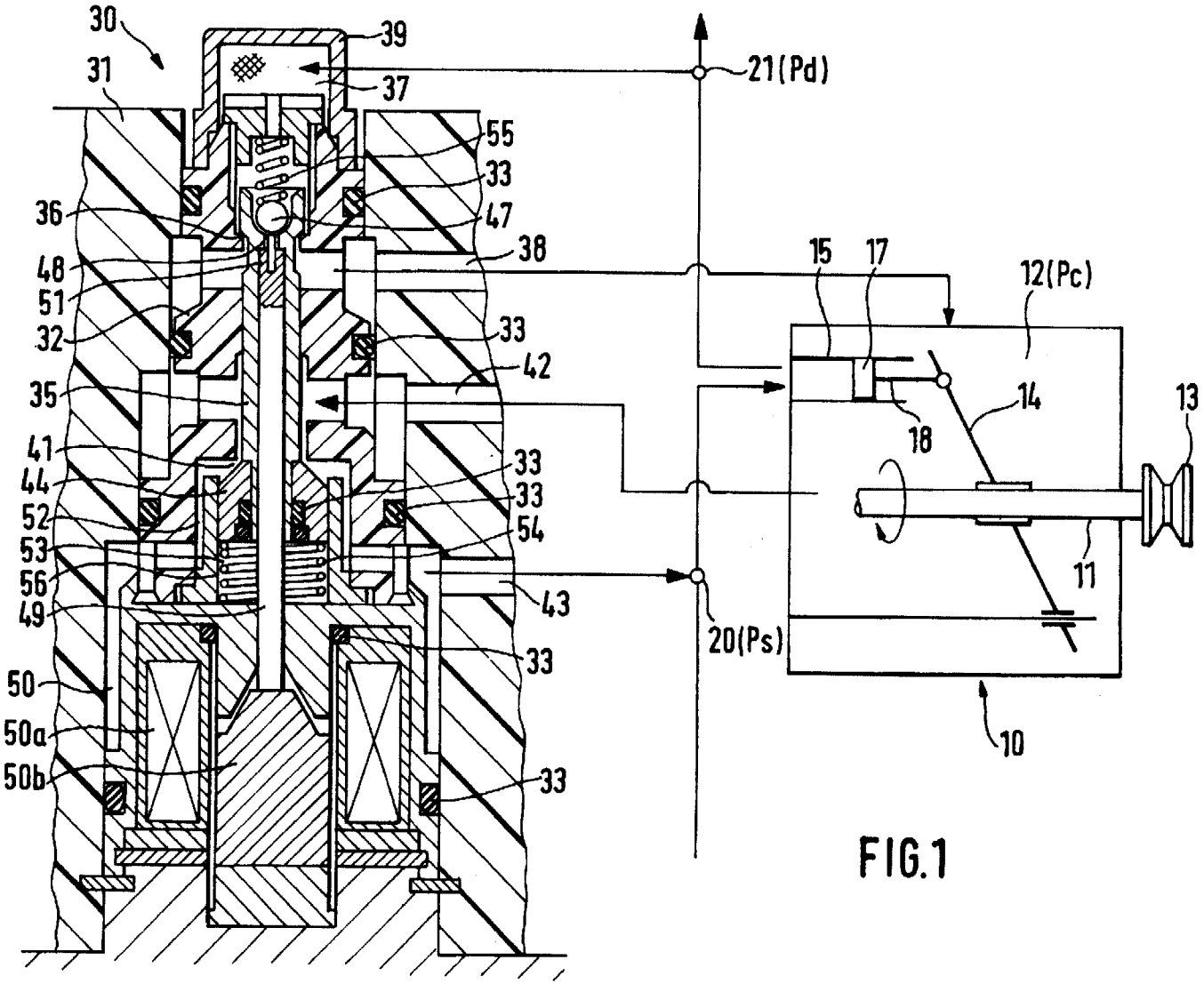
FIG. 1: Schematically a variable-capacity compressor for use with a refrigerating plant for an automotive air conditioning equipment with a cross-sectional view of its capacity control device showing the maximum capacity state.

A rotating shaft 11 is mounted in an airtight crank case 12 of a variable capacity compressor 10 and is rotatively driven by a driving pulley 13. A rocking plate 14 is disposed in the crank case 12 on shaft 11 in an inclined fashion with respect to the rotating shaft 11, and is rocked by the rotation of the rotating shaft 11.

In a cylinder 15 disposed in the crank case 12, a piston 17 is coupled to the rocking plate 14 through a rod 18.

Accordingly, when the rocking plate 14 is rocked, the piston 17 reciprocates in the cylinder 15 to suck refrigerant into the cylinder 15 from a suction chamber 20 formed upstream of the cylinder 15, and to discharge it into a discharge chamber 21 downstream after a refrigerant is compressed in the cylinder 15.

A block 31 housing a capacity control device 30 is formed e.g. in the same block as the variable-capacity compressor 10. In a coaxial stepped bore formed in block 31, a body cylinder 32 is fitted. O-rings 33 serve for sealing between portions of the block 31 and fitting portions of the body cylinder 32.

In a through-hole formed along the center axis of the body cylinder 32, there is disposed a hollow operating rod 35 defining an opening/closing valve member which is free to advance or retreat axially. A high-pressure valve portion 36 is formed between the head or upper end position of the operating rod 35 and the body cylinder 32.

The high-pressure valve portion 36 is adapted to open or close a communicating path between a high-pressure communicating path 37 leading to the discharge chamber 21 at high pressure pressure Pd and a pressurising flow path 38 leading to the crank case 12. When the high-pressure valve portion 36 is opened, the discharge chamber 21 communicates with the crank case 12 to increase the pressure in the crank case 12. The inlet portion to the high-pressure valve portion 36 is covered with a filter 39 for removing dust, etc.

Between a big valve member 44 fixed to the other end portion of the operating rod 35 and the body cylinder 32, there is formed a low-pressure valve portion 41, which is adapted to open or close a communicating path between a pressure reducing flow path 42 leading to the crank case 12 and a low-pressure communicating path 43 leading to the suction chamber 20. When the low-pressure valve portion 41 opens, the crank case 12 communicates with the suction chamber 20 to decrease the pressure in the crank case 12.

As shown in FIG. 1, the high-pressure valve portion 36 and the low-pressure valve portion 41 are opened or closed at the same time by the operating rod 35, which is axially advanceable and retreatable, so that when the high-pressure valve portion 36 is closed, the low-pressure valve portion 41 is opened, and when the high-pressure valve portion 36 is opened, the low-pressure valve portion 41 is closed.

Along the centre axis of the operating rod 35 there is formed a through-hole. In the vicinity of the opening of operating rod 35 on the side of the high-pressure communicating path 37, there is formed a pilot valve portion 48 which can be opened or closed by means of a ball valve 47.

The pressure responding diameter of the pilot valve portion 48 is formed much smaller than that of the high-pressure valve portion 36 (for example, ¼). Accordingly, since the effective pressure-receiving area is proportionate to the square of the hole diameter, the effective pressure-receiving area for the pilot valve portion 48 is much smaller than that for the high-pressure valve portion 36 (for example 1/16).

In the through-hole formed in the operating rod 35, a driving rod 49 is provided for transmitting the movement of an electromagnetic solenoid 50 (electromagnetic coil **50*a* iron core 50*b*) for opening or closing the pilot valve portion 48 by means of the ball valve 47. Driving rod 49 is loosely fitted in the through hole so that refrigerant can pass through the clearance between the outer periphery of the driving rod 49 and the inner periphery of the through-hole of operating rod 35**.

In the pilot valve portion 48, a small rod 51 loosely passing through a valve seat in that portion is interposed between driving rod 49 and ball valve 47 transmitting the advance or retreat motion of the driving rod 49 to the ball of the base valve 47.

The valve member 44 fixed to the other end portion of the operating rod 35 is axially movably fitted in a tubular case 52. The clearance between the outer peripheral surface of the driving rod 49 and the operating rod 35 conductively leads to a pressurising chamber 53 defined by the tubular case 52 and the valve member 44.

Therefore, the pilot valve portion 48 is adapted to open or close the communicating path between the high pressure communicating path 37 and the pressurising chamber 53. When pilot valve portion 48 is opened, the discharge chamber 21 communicates with the pressurising chamber 53 to increase the pressure in the pressurising chamber 563. Since pressurising chamber 53 is as big as valve member 44, the diameter of the pressurising chamber 53 is bigger than the diameter of the high-pressure valve portion 36 for example, twice as big.

In the tubular case 52, a leakage hole 54 for conductively connecting the pressurising chamber 53 to the low-pressure communicating path 43 is formed. Leakage hole 54 has a much smaller diameter than the diameter of the opening or valve seat in the pilot valve portion 48. The refrigerant in the pressurising chamber 53 gradually leaks into the low-pressure communicating path 43 so that the pressure in the pressurising chamber 53 becomes an appropriate pressure between Pd and Ps. Compression coil springs 55, 56 abut on the ball valve 47 and the valve member 44, respectively, to bias the operating rod 35 in both directions.

Figure 5:
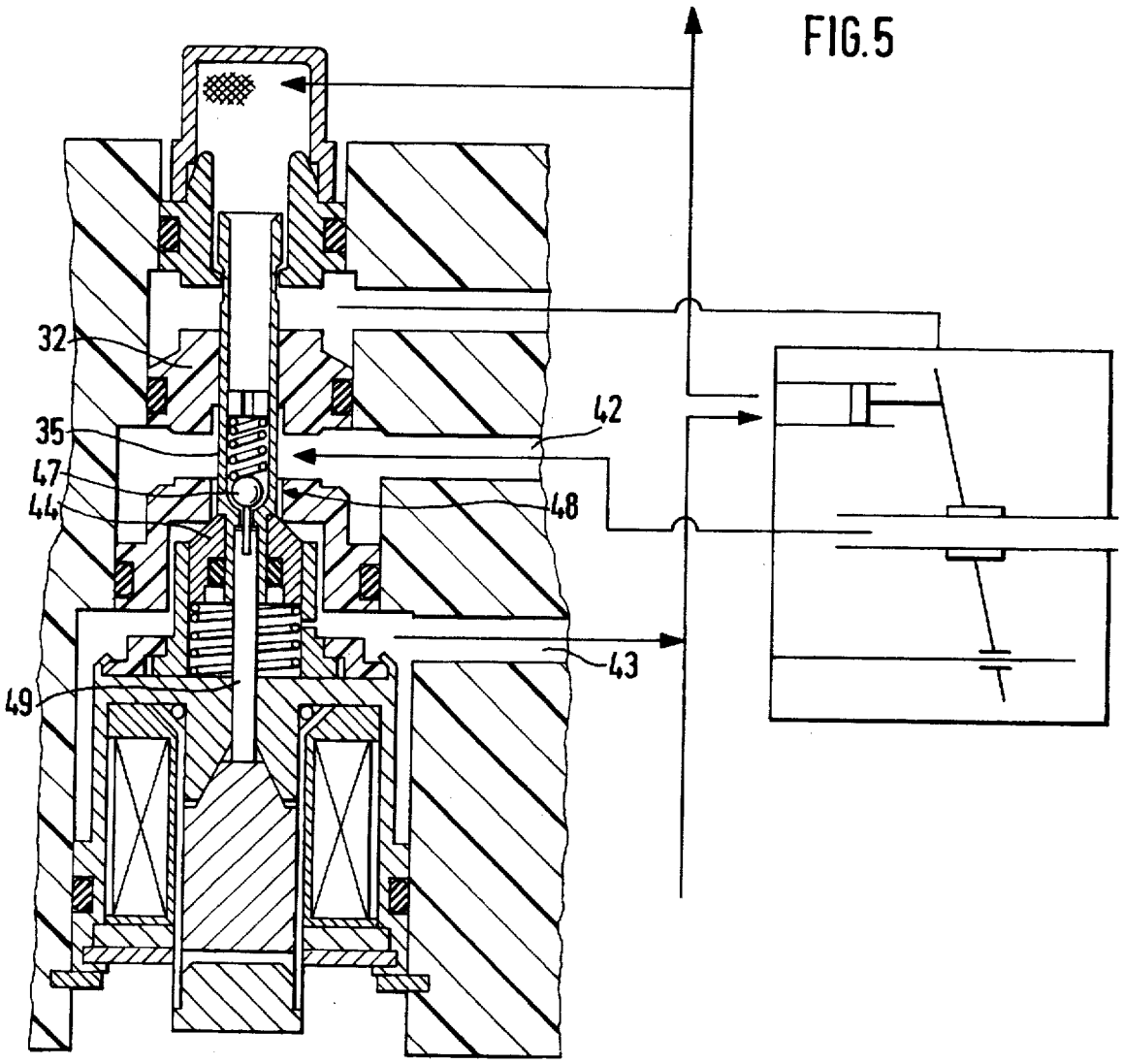
FIG. 5: A cross-sectional view of a modified embodiment.
Figure 6:
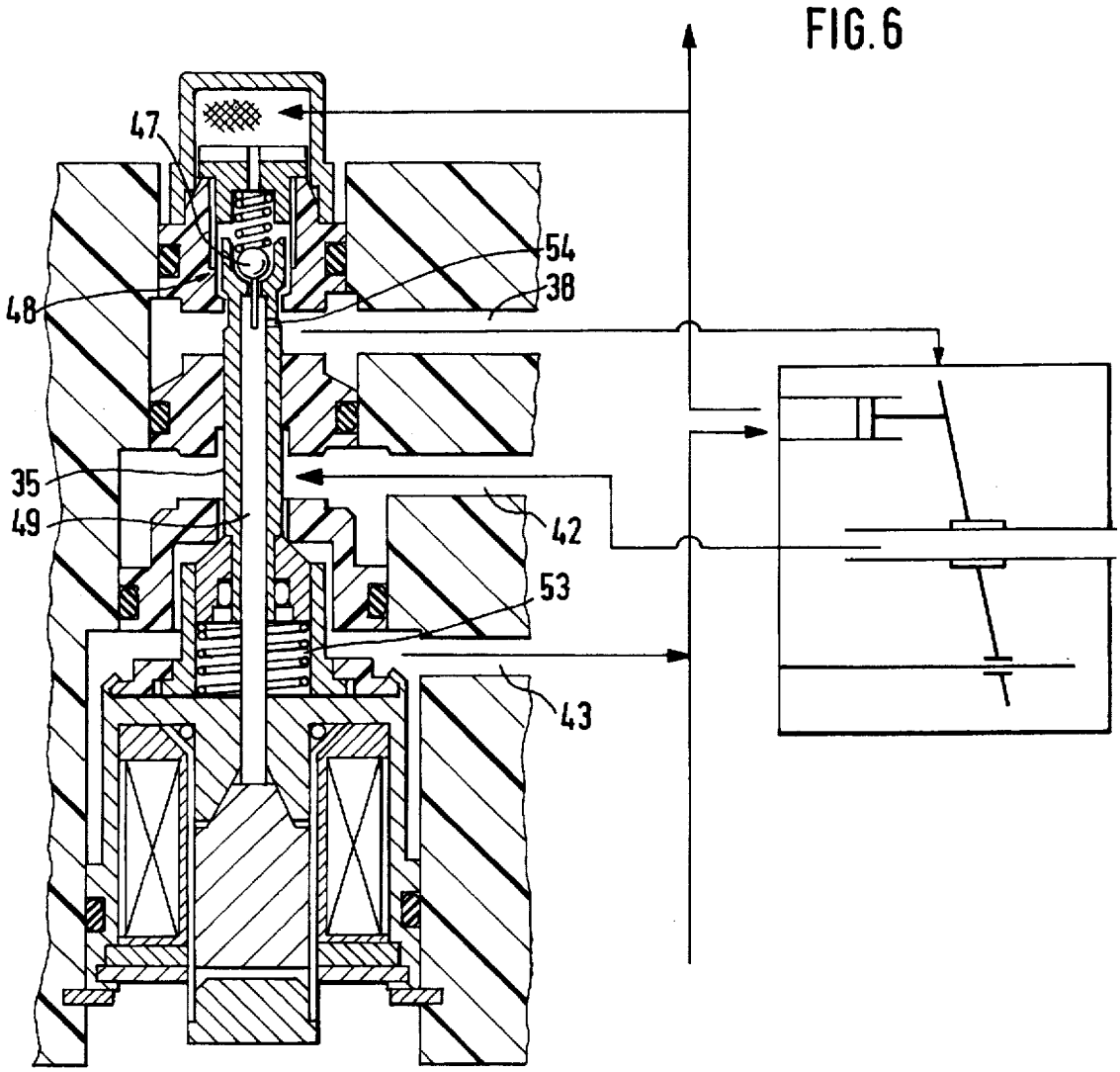
FIG. 6: A cross-sectional view of another modified embodiment

In the embodiment of FIG. 6 leakage hole 54 is provided in operating rod 35 at a higher position than in FIG. 1 and close to pilot valve portion 48, i.e. below the opening into the through hole of the operating rod 35 adjacent to the lower side of ball valve 47. Leakage hole 54 in FIG. 6 conductively connects pressurising flow-path 38 to the through-hole of operating rod 35 and via said through-hole to pressurising chamber 53. The purpose of the leakage hole 54 in this elevated position is similar as explained in connection with leakage hole 54 in the lower position shown in FIG. 1. In the embodiment of FIG. 1 driving rod 49 is formed with a long longitudinal extension bridging the distance between movable iron core **50*b* and the pilot valve portion 48 situated at the upper end of operating rod 35. In the embodiment as shown in FIG. 5, a shortened driving rod 49 is used. In addition the pilot valve portion 48 is provided within a lower portion of operating rod 35 and close to valve member 44. In general terms, pilot valve portion 48 is situated between pressure reducing flow-path 42 and low-pressure communicating path 43**.

In the state shown in FIG. 1 in which the capacity discharge amount of the variable-capacity compressor 10 is large with a large inclination angle of the rocking plate 14, the high-pressure valve portion 36 is closed and the low-pressure valve portion 41 is opened. The pressure Pc in the variable-capacity compressor 10 is almost equal to the pressure Ps in the suction chamber 20.

In order to lower the capacity of the compressor the electromagnetic coil **50*a* of the electromagnetic solenoid 50 is electrically energised to cause the iron core 50*b* to press the driving rod 49 upwardly and to move the ball valve 47 outwardly to open the pilot valve portion 48**.

At this time, when the high-pressure valve portion 36 is intended to be directly opened, the electromagnetic solenoid 50 would generate heat if a great driving force would be required to overcome a differential pressure between Pd and Pc which exerts on the high-pressure valve portion 36. Since, however, the effective pressure-receiving area of the pilot valve portion 48 is much smaller than that of the high-pressure valve portion 36, the pilot valve portion 48 can be opened with a small driving force, and accordingly, the calorific value of the electromagnetic solenoid 50 is very low.

Figure 2:
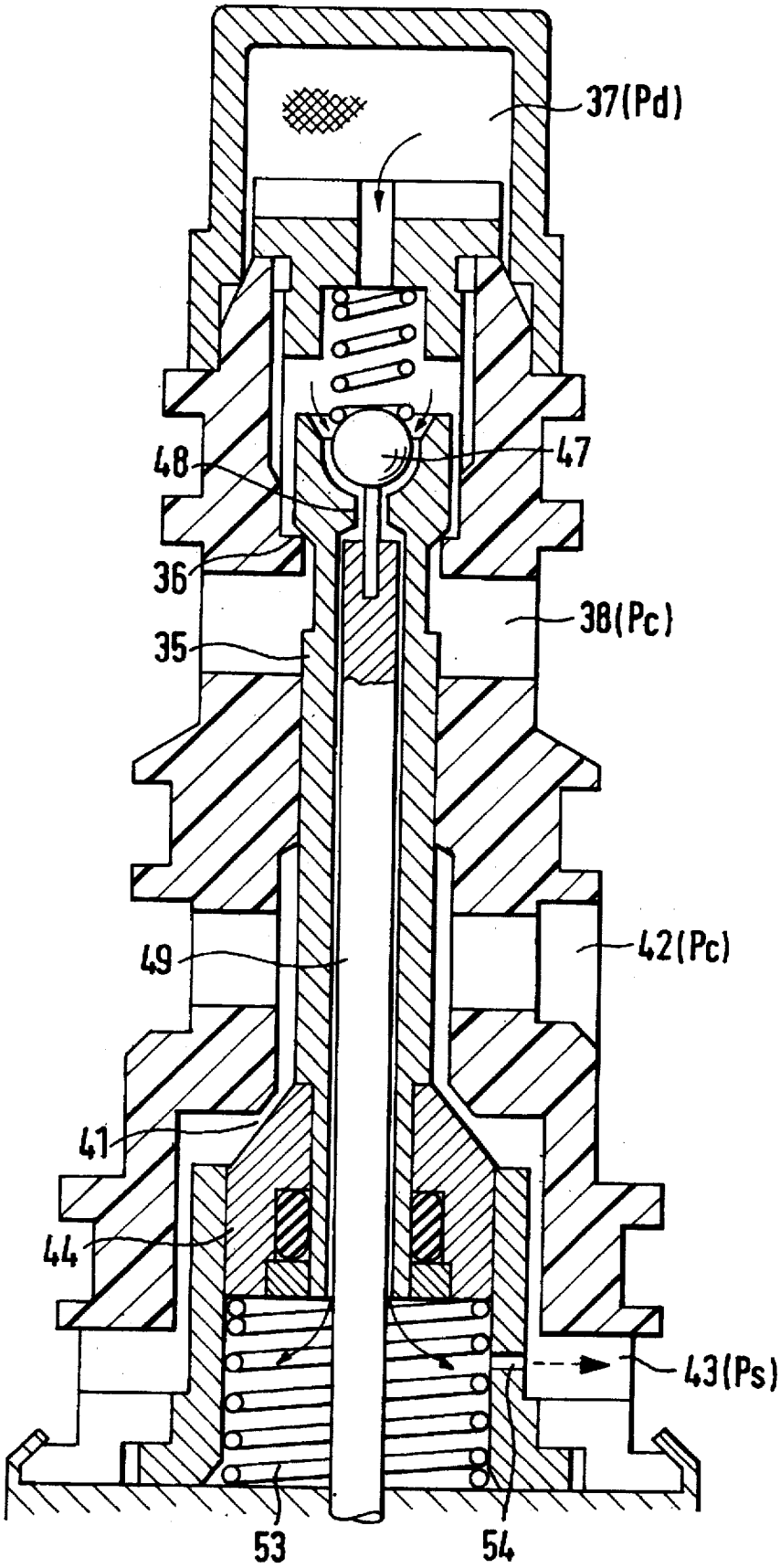
FIG. 2: A cross-sectional view of a part of the capacity control device illustrating a state immediately after current flows through a solenoid.

FIG. 2 shows a state immediately after the pilot valve portion 48 has been opened. The low-pressure valve portion 41 still remains opened. The high-pressure valve portion 36 is closed. However, since the pilot valve portion 48 has been opened, whereby the high-pressure refrigerant at the high-pressure communicating path 37 side passes along the outer periphery of the driving rod 49 into the pressurising chamber 53 the refrigerant pressure in the pressurising chamber 53 gradually increases. Then, since the diameter of the pressurising chamber 53 is bigger than that of the high-pressure valve portion 36 and has a bigger effective pressure-receiving area, as the pressure in the pressurising chamber 53 increases, the force acting on the operating rod 35 in the opening direction of the high-pressure valve portion 36 becomes greater than the force in the closing direction.

Figure 3:
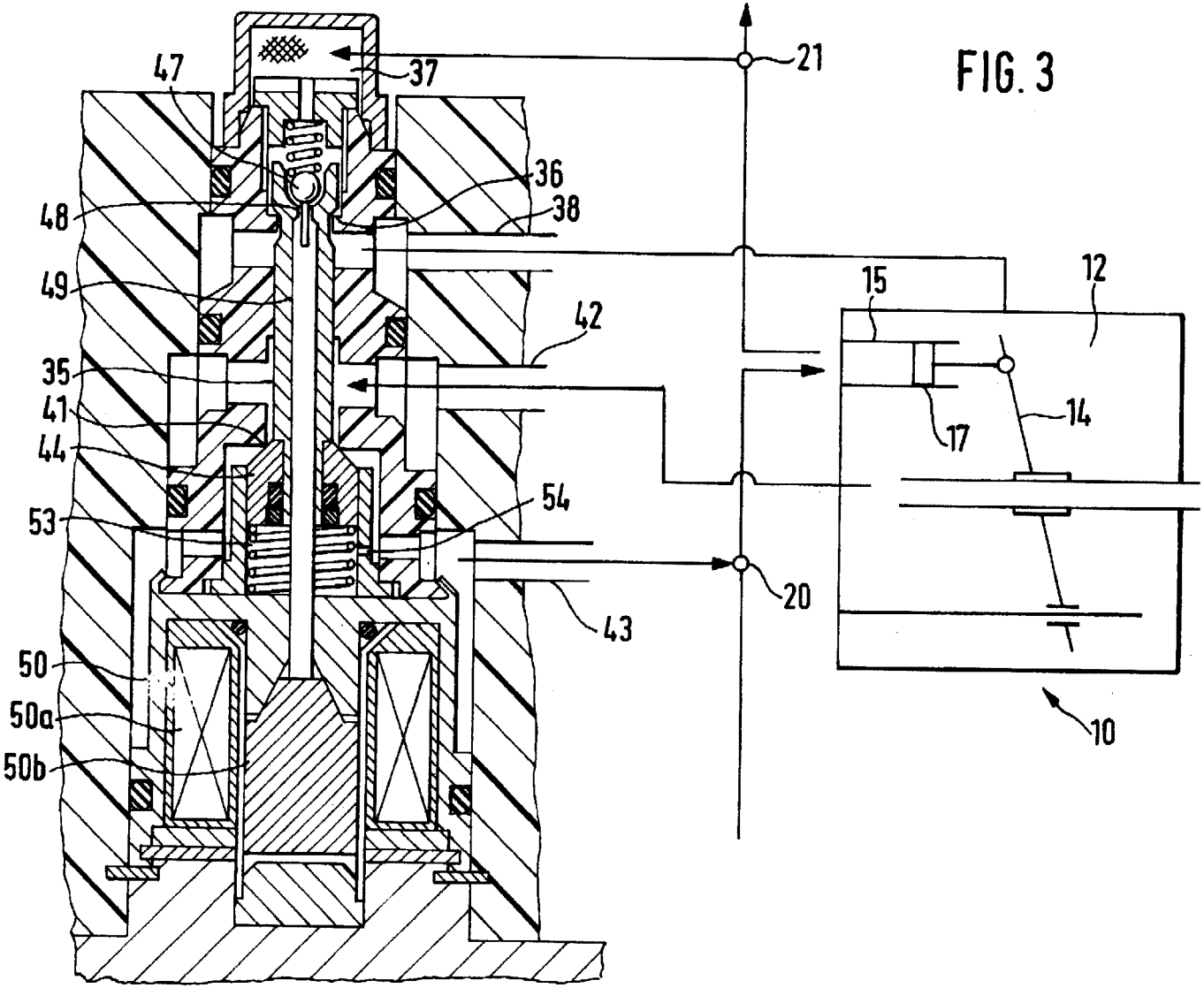
FIG. 3: A cross-sectional view showing an intermediate capacity state.
Figure 4:
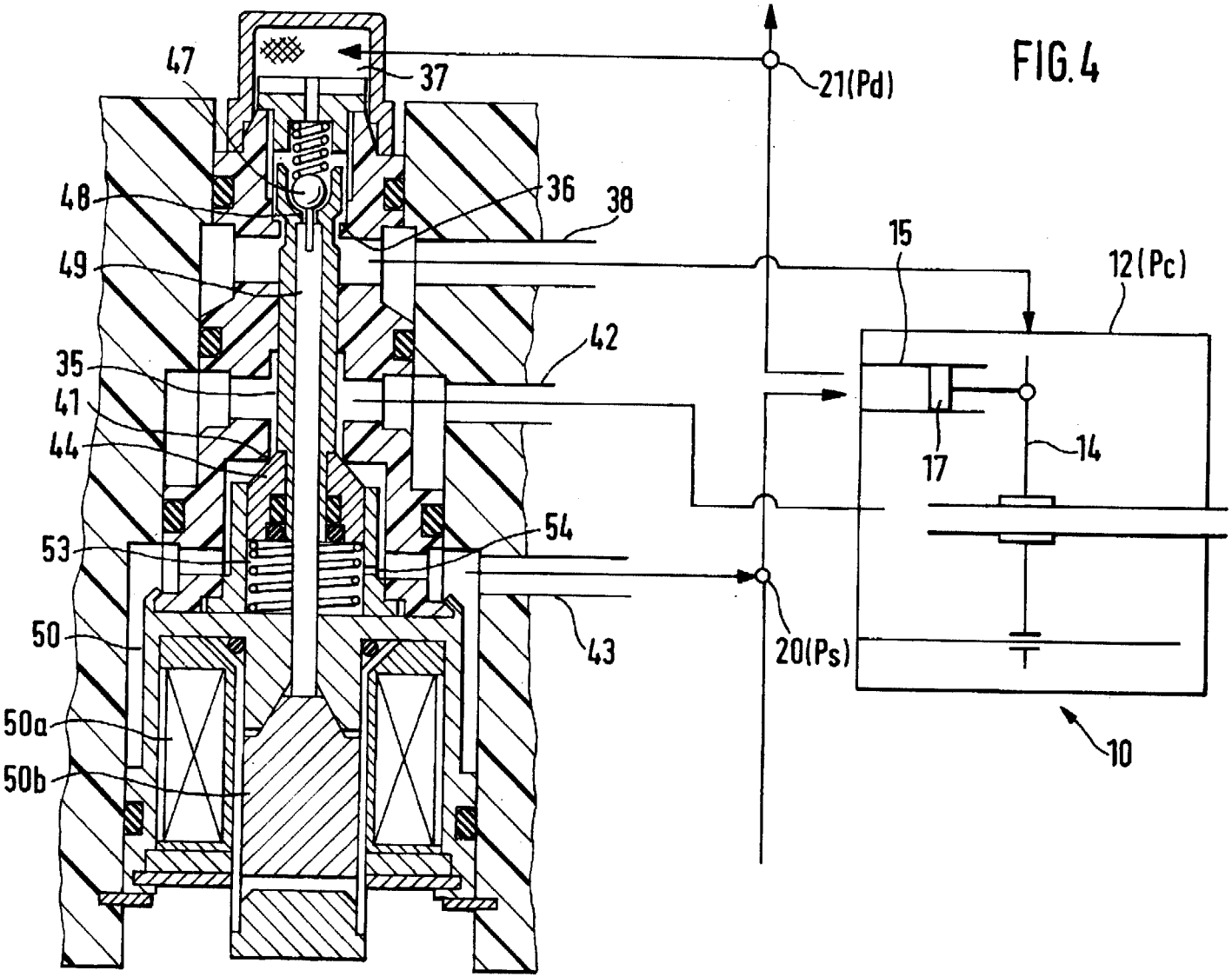
FIG. 4: A cross-sectional view showing the minimum capacity state.

When the opening force magnitude for the high-pressure valve portion 36 is surpassed, the high-pressure valve portion 36 starts opening as shown in FIG. 3. In conformity therewith, the low-pressure valve portion 41 starts closing. Then, the pressure Pc in the crank case 12 starts increasing to reduce the inclination angle of the rocking plate 14, thus reducing the capacity of the variable-capacity compressor 10.

Upon continuation, the low-pressure valve portion 41 fully closes and the high-pressure valve portion 36 enters the fully-opened state. The pressure Pc in the crank case 12 becomes a high pressure equal to the pressure Pd in the discharge chamber 21. Thus, the inclination angle of the rocking plate 14 further becomes smaller, and the capacity of the variable-capacity compressor 10 becomes minimal. In this embodiment, the inclination angle of the rocking plate 14 becomes zero, the rocking member is adjusted (pneumatically) an the shaft, and the capacity of the variable-capacity compressor 10 becomes zero.

The pressure in the pressurising chamber 53 then is maintained at a pressure between Pd and Ps by taking a balance between the refrigerant at high pressure Pd flowing from the pilot valve portion 48 and the refrigerant flowing from the leakage hole 54 into the low-pressure communicating path 43 at low pressure (Ps). The capacity of the compressor 10 cannot only be changed from a maximum to a minimum, but it is possible to stop the operating rod 35 in any intermediate position in which both the high-pressure valve portion 36 and the low-pressure valve portion 41 are opened as shown in FIG. 3. This is done by adjusting the amount of current for the electromagnetic coil **50*a* of the electromagnetic solenoid 50. Since the rocking plate 14 inclines at an angle adapted thereto, the capacity discharge amount of the variable capacity compressor 10 can be controlled arbitrarily. It is recommendable to match the magnitude of the current for the electromagnetic coil 50*a* and the capacity of the variable-capacity compressor 10** in order to achieve a linear change.

According to the adaptation of the sizes of the pressure responding surface areas, the high-pressure valve portion can be opened or closed with a desirable small solenoid force because the high-pressure valve portion is opened or closed with the assistance of the pressure acting in the pressurising chamber on the operating member having a bigger effective pressure-receiving area than the high-pressure valve portion. The pilot valve portion has an effective pressure-receiving area that is smaller than that of the high-pressure valve portion for opening or closing the communicating path between the crank case and the discharge chamber at high pressure. Therefore, the electromagnetic solenoid for driving the valve requires only a weak current. This greatly suppresses heat generation in the electromagnetic coil and prevents defects resulting from heat generation.

We claim:

1. A capacity control device for a variable-capacity compressor, said variable-capacity compressor having 1) a rocking member with an inclination angle that is variable with respect to a rotating shaft in an airtight crank case, the rocking member being driven by rotational motion of said rotating shaft for rocking motion, and 2) a piston, connected to said rocking member, for discharging a refrigerant into a discharge chamber after sucking the refrigerant from a suction chamber into a cylinder for compression by reciprocating, said capacity control device controlling the capacity of said variable-capacity compressor by varying the difference between a pressure in said crank case and a pressure in said suction chamber to vary the inclination angle of said rocking member and hence to change the discharge amount of refrigerant, said control device comprising:

a high-pressure valve portion for opening or closing a fluid communication path between said discharge chamber and said crank case, said high-pressure valve portion having an effective pressure-receiving area;

a low-pressure valve portion for opening or closing a fluid communication path between said suction chamber and said crank case;

a valve operating member coupled to said high-pressure valve portion and to said low-pressure valve portion and operable to reverse an open-close relationship between said high-pressure valve portion and said low-pressure valve portion by advancing or retreating;

a pressurising chamber for applying pressure to said valve operating member in a direction that opens said high-pressure valve portion, said pressurizing chamber having an effective pressure-receiving area that is larger than the effective pressure-receiving area of said high-pressure valve portion;

and a pilot valve portion having an effective pressure-receiving area that is smaller than said effective pressure-receiving area of said high-pressure valve portion; and an electromagnetic solenoid that drives said pilot valve portion to open or close a fluid communication path between said discharge chamber and said pressurising chamber.

2. Device as in claim 1, wherein one end portion of the valve operating member forms a piston member situated in a slidable engagement in said pressurising chamber, said piston member having an effective pressure-receiving area that is larger than said effective pressure-receiving area of said high-pressure valve portion.

3. Device as in claim 2, wherein the low-pressure valve portion includes a movable valve member, and wherein the piston member is formed integrally with the movable valve member of the low-pressure valve portion.

4. Device as in claim 1, wherein the valve operating member is a hollow operating rod receiving a longitudinally movable driving rod, wherein one end of the driving rod is positively actuatable by a movable core of the solenoid and the other end of the driving rod is adapted to engage a closure member of the pilot valve portion.

5. Device as in claim 4, wherein the driving rod is disposed with clearance within a through hole of the valve operating member and defines a longitudinal communication path between said pilot valve portion and said pressurizing chamber.

6. Device as in claim 4, wherein the effective pressure-receiving area of the pilot valve portion is defined by a sealing area between said closure member and a valve seat opening of the pilot valve portion, said valve opening being a prolongation of a through hole of the valve operating member.

7. Device as in claim 6, wherein the leakage hole is smaller in diameter than said valve seat opening of said pilot valve portion.

8. Device as in claim 6, wherein the leakage hole is situated in a wall of the valve operating member at a location which is nearer to the high-pressure valve portion than to the low-pressure valve portion.

9. Device as in claim 6, further comprising a stationary tubular case confining the pressurising chamber, and wherein the leakage hole is situated in said stationary tubular case.

10. Device as in claim 1, wherein the pilot valve portion is situated within a portion of the valve operating member defining a movable valve member of the high-pressure valve portion.

11. Device as in claim 1, wherein said pilot valve portion comprises a spring loaded ball valve.

12. Device as in claim 1, wherein a leakage hole is provided in the valve operating member and establishes a flow connection between said pressurising chamber and either 1) a low-pressure communication path leading to said suction chamber or 2) a pressurising flow path leading to said crank case.

13. Device as in claim 1, wherein the pilot valve portion is situated within a portion of the valve operating member defining a movable valve member of said low-pressure valve portion.

14. A capacity control device for a variable-capacity compressor, said variable-capacity compressor comprising 1) an airtight crank case in fluid communication with a suction chamber and a discharge chamber, 2) a shaft rotatably mounted on said crank case, 3) a rocking member mounted on said shaft so as to have a variable inclination angle, and 4) a piston and cylinder device mounted on said rocking member and operable to suck refrigerant from said suction chamber and to discharge the refrigerant into said discharge chamber, said capacity control device controlling the capacity of said variable-capacity compressor by varying the difference between a pressure in said crank case and a pressure in said suction chamber to vary the inclination angle of said rocking member and hence to change the discharge amount of refrigerant, said capacity control device comprising:

(A) a high-pressure valve portion which is selectively actuatable to open or close a fluid communication path between said discharge chamber and said crank case, said high-pressure valve portion having an effective pressure receiving area;

(B) a low-pressure valve portion which is selectively actuatable to open or close a fluid communication path between said suction chamber and said crank case;

(C) a valve operating member which actuates said high-pressure valve portion and said low-pressure valve portion, said valve operating member being movable between (1) a first position in which said valve operating member causes said high-pressure valve portion to assume an open position and said low-pressure valve portion to assume a closed position and (2) a second position in which said valve operating member causes said high-pressure valve portion to assume a closed position and said low-pressure valve portion to assume an open position;

(D) a pressurizing chamber in fluid communication with said valve operating member, wherein fluid pressure in said pressurizing chamber tends to drive said valve operating member towards said first position, and wherein said pressurizing chamber has an effective pressure receiving area that is larger than the effective pressure receiving area of said high-pressure valve portion;

(E) a pilot valve portion which is selectively actuatable to open or close a fluid communication path between said discharge chamber and said pressurizing chamber, said pilot valve portion having an effective pressure receiving area that is smaller than the effective pressure receiving area of said high-pressure valve portion; and (F) an electromagnetic solenoid which actuates said pilot valve portion.

15. A refrigerant supply system comprising:

(A) a variable-capacity compressor, said variable-capacity compressor including (1) an airtight crank case in fluid communication with a suction chamber and a discharge chamber, (2) a shaft rotatably mounted on said crank case, (3) a rocking member mounted on said shaft so as to have a variable inclination angle, and (4) a piston and cylinder device mounted on said rocking member and operable to suck refrigerant from said suction chamber and to discharge the refrigerant into said discharge chamber; and (B) a capacity control device which controls the capacity of said variable-capacity compressor by varying the difference between a pressure in said crank case and a pressure in said suction chamber to vary the inclination angle of said rocking member and hence to change the discharge amount of refrigerant, said capacity control device including (1) a high-pressure valve portion which is selectively actuatable to open or close a fluid communication path between said discharge chamber and said crank case, said high-pressure valve portion having an effective pressure receiving area, (2) a low-pressure valve portion which is selectively actuatable to open or close a fluid communication path between said suction chamber and said crank case, (3) a valve operating member which actuates said high-pressure valve portion and said low-pressure valve portion, said valve operating member being movable between (a) a first position in which said valve operating member causes said high-pressure valve portion to assume an open position and said low-pressure valve portion to assume a closed position and (b) a second position in which said valve operating member causes said high-pressure valve portion to assume a closed position and said low-pressure valve portion to assume an open position, (4) a pressurizing chamber in fluid communication with said valve operating member, wherein fluid pressure in said pressurizing chamber tends to drive said valve operating member towards said first position, and wherein said pressurizing chamber has an effective pressure receiving area that is larger than the effective pressure receiving area of said high-pressure valve portion, (5) a pilot valve portion which is selectively actuatable to open or close a fluid communication path between said discharge chamber and said pressurizing chamber, said pilot valve portion having an effective pressure receiving area that is smaller than the effective pressure receiving area of said high-pressure valve portion, and (6) an electromagnetic solenoid which actuates said pilot valve portion.

* * * * *